United States Patent [19]

Kulig

[11] 4,371,110

[45] Feb. 1, 1983

[54] SHEET CAKE TRAY CARTON

[75] Inventor: Francis V. Kulig, Morris, Ill.

[73] Assignee: Federal Paper Board Company, Inc., Montvale, N.J.

[21] Appl. No.: 242,438

[22] Filed: Mar. 11, 1981

[51] Int. Cl.[3] ..... B65D 5/24

[52] U.S. Cl. ..... 229/31 FS; 229/34 R

[58] Field of Search ..... 229/31 FS, 34 R, 35

[56] References Cited

U.S. PATENT DOCUMENTS

| | | | |
|---|---|---|---|
| 1,755,694 | 4/1930 | Keppler | 229/34 R |
| 2,143,308 | 1/1939 | Flack | 229/34 R |
| 2,218,509 | 10/1940 | Goodyear | 229/35 |
| 2,621,783 | 12/1952 | Buttery | 229/35 |
| 2,986,320 | 5/1961 | Nicholls | 229/34 R |
| 3,137,434 | 6/1964 | Berg | 229/31 FS |
| 3,904,104 | 9/1975 | Kane | 229/3.5 |

FOREIGN PATENT DOCUMENTS

| | | | |
|---|---|---|---|
| 216721 | 8/1958 | Australia | 229/34 R |
| 688952 | 6/1964 | Canada | 229/31 FS |
| 1120863 | 7/1968 | United Kingdom | 229/34 R |

*Primary Examiner*—Herbert F. Ross

*Attorney, Agent, or Firm*—FitzGibbon, Roehrig, Greenawalt & Stone

[57] ABSTRACT

There is disclosed a carton for handling the preparation of a bakery product, such as a sheet cake, which is characterized by a modified Simplex type tray formed with a cut and scored blank of paperboard, which may be furnished the user in flattened form for ready erection into a shallow depth tray structure suitable for preparation therein of a sheet cake including baking in a conventional oven, icing and/or decorating without removal from the tray, cutting for serving, with consistent portion control, obtainable by following guide means on the tray walls, and releasing and dropping the side and end walls to enable access to portions adjacent the walls for easy serving, the walls being refoldable to upstanding position for receiving a telescoping lid when all the product has not been removed for serving.

4 Claims, 8 Drawing Figures

SHEET CAKE TRAY CARTON

BACKGROUND OF THE INVENTION

This invention relates to paperboard containers for processing and handling a baker product and is more particularly concerned with improvements in a processing and packaging arrangement in which a collapsed container is provided in the form of a shallow rectangular tray of a size to accomodate a rather large sheet cake while it is prepared for baking, baked and fully processed and which is then adapted to be cut into consistent serving portions, with the tray having peripheral walls which are readily released and swung down to provide ready access to the serving portions.

In the preparation of foods in airline kitchens, caterers, hotel and fast food kitchens sheet cake is a popular form of desert which has heretofore been handled largely by baking in a metal tray, removing the product and turning it on a board or sheet for icing and/or decorating after which it is cut into small portions for serving by use of a knife or sometimes by a special cutting tool for this purpose. Obviously, considerable work is required by the baker or his helper and reusable tools are employed which must be thoroughly cleaned for reuse.

It has been recognized that some alternative arrangement which would reduce the amount of labor and provide a greater convenience in handling this product would be highly desirable. Some efforts have been made to substitute single use, disposable tools, such as, a disposable or single use tray formed of relatively thin aluminum but this eliminates only a tray washing step and is costly, considering the cost of the aluminum tray and does not provide any other additional convenience or flexibility.

It is a general object of the present invention to provide, as an alternate to former arrangements, a disposable, single use, paperboard container which is constructed so that it may be used to handle these operations more readily and at lesser cost while providing some additional features which are considered advantageous.

It is a more specific object of the invention to provide a paperboard carton for use in an airline kitchen, or the like, which includes a shallow depth tray having a coating or laminate which will condition the paperboard to withstand ordinary baking oven temperatures without destruction, which is biodegradable, which may be furnished flat and set up by the user, which may have its peripherial walls readily released, after baking, to expose the cake product for icing and/or decorating, which has makings on its walls for guiding the user in cutting the finished product in uniform size pieces with a conventional knife and which may be provided with a readily disposable lid for enclosing any unused portion of the product when the side walls are swung upwardly and returned to erected position.

A further object of the invention is to provide a carton formed of paperboard which includes a single use, disposable, shallow tray suitable for preparing a bakery product, in the form of a sheet cake, by baking in a conventional oven, icing or decorating the product while it remains in the tray, and cutting the product for serving relatively small serving portions with the tray providing means to aid in consistent portion control, without the use of special cutting tools, and including a tray structure in which the sidewalls may be readily released at the corners and swung down enabling ready access to and easy serving of the product.

The invention which is herein disclosed and claimed comprises an arrangement for providing a disposable paperboard container for use in baking and serving a bakery product, such as, a sheet cake, wherein a relatively shallow depth tray is provided which can be employed for fully processing the product in a conventional bakery oven without material damage, which has hinged double panel side and end wall structures with foldable, corner connecting, integral webs which can be readily raised into upright position and locked in such position, with provision for readily tearing a top fold portion to release the wall structures and enable them to be folded down for ready and convenient access to portions of the product which can be divided into smaller servings of uniform size with an ordinary cutting tool guided by markings on the top edges of the side and end walls and thereby obtain consistent portion control.

The foregoing and other objects and advantages of the invention will become more apparent when consideration is given to the following description of the preferred form of the invention and the accompanying drawings in which corresponding parts are indicated by the same numerals in the various views.

DESCRIPTION OF THE PREFERRED EMBODIMENT

Figure 1:
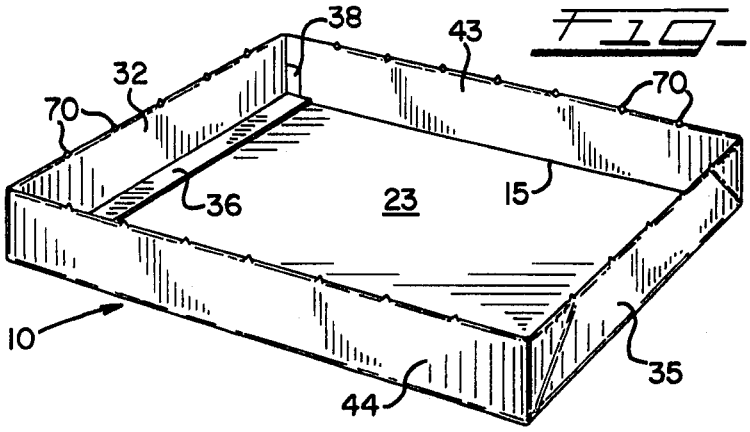
FIG. 1 is a perspective view of a tray portion of a carton which embodies the principle features of the invention and which is particularly adapted for use in processing a relatively large sheet cake, decorating it, and reducing it to small serving portions.
Figure 4:
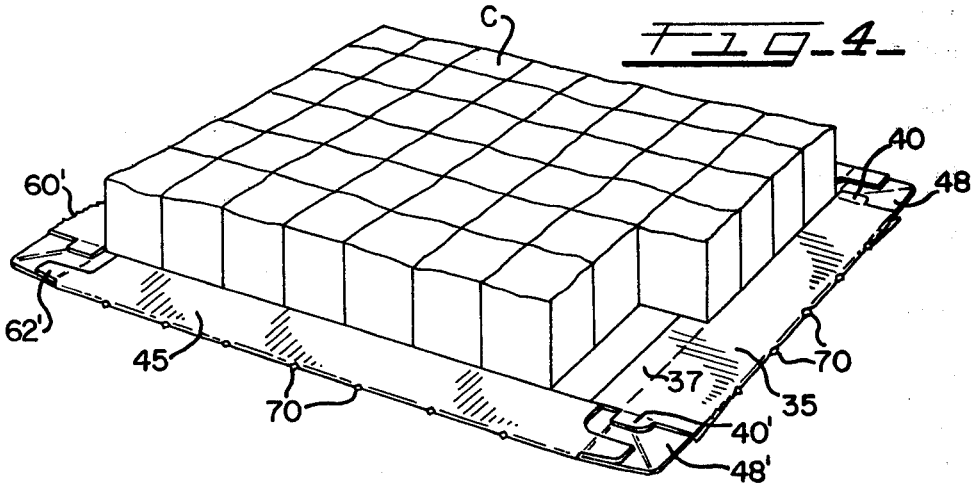
FIG. 4 is a perspective view of the tray with all four sidewalls fully open and the cake ready for finish cutting.
Figure 6:
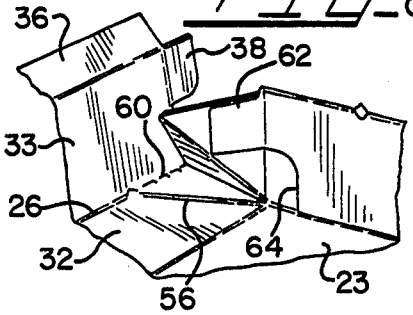
FIG. 6 is a fragmentary perspective view, to an enlarged scale, of an inside corner of the tray of FIG. 1 in partially opened condition.
Figure 5:
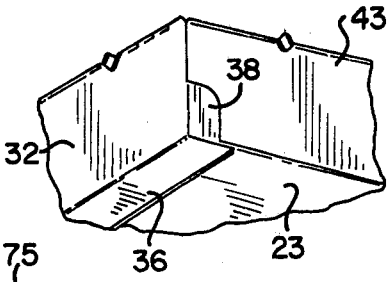
FIG. 5 is a fragmentary perspective view, to an enlarged scale, of an inside corner of the tray of FIG. 1.
Figure 8:
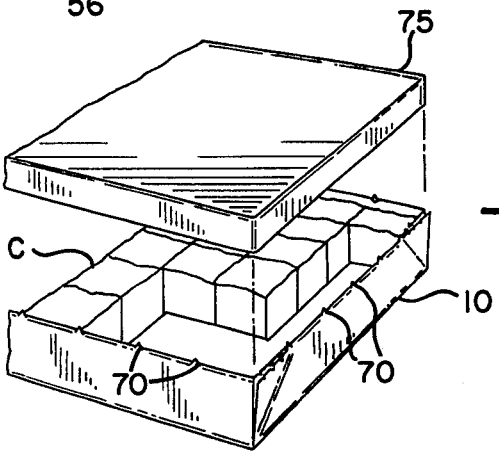
FIG. 8 is an exploded perspective view of a partially emptied tray with the walls swung to upright position and with a cover forming lid adapted to telescope over the top margins of the upright sidewalls.

Referring first to FIG. 1 there is illustrated an empty rectangular paperboard tray-like container 10 which is especially designed for oven processing a bakery article, specifically, a sheet cake, subsequently decorating or icing the processed cake C without removing it from the container 10, and cutting the cake into servings of uniform size with a conventional knife guided by markings on the peripheral walls, which walls may be readily released and swung down (FIG. 4) to provide access to the cake side walls without damage to the same and which may be later swung to the upright tray forming position for accepting a telescoping cover member (FIG. 8) in the event not all the cake is needed for serving. The entire container, that is, both tray and cover are biodegradable and adapted for single use and destruction in a manner which meets reasonable environmental requirements.

Figure 7:
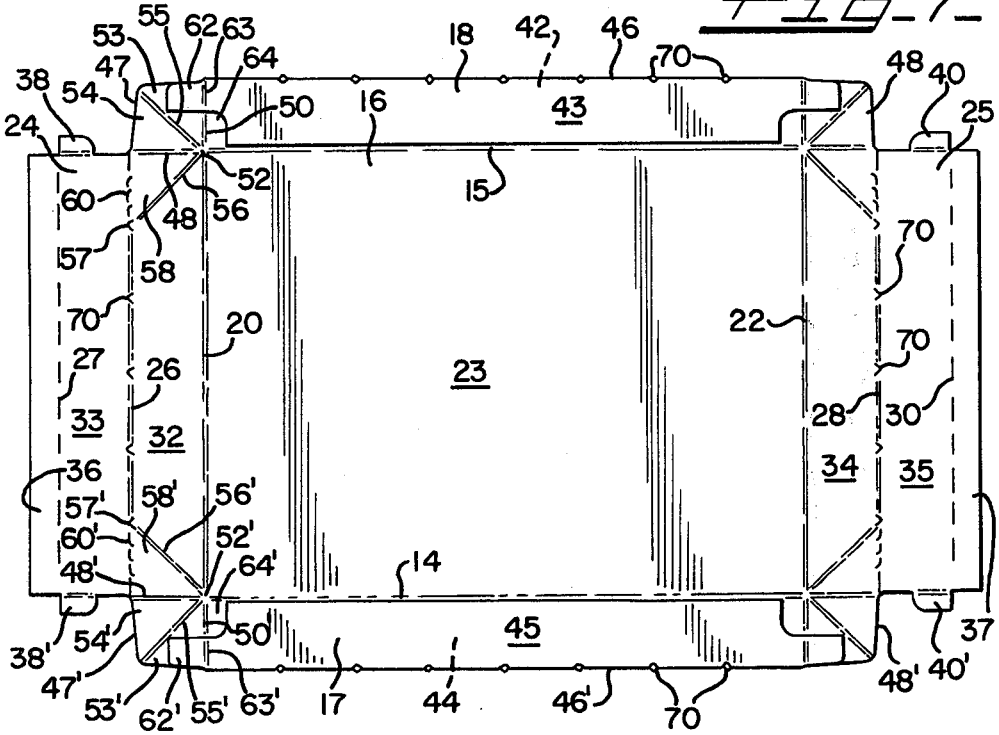
FIG. 7 is a plan view of a paperboard blank which is cut and scored preparatory to forming the tray of FIG. 1.

The blank 12 in FIG. 7 comprises a generally rectangular sheet of paperboard of suitable weight or gauge which is cut and scored to provide the tray-like container of FIG. 1 which is a modified form of a tray construction generally referred to as a Simplex style container and which is treated with a heat resistant film or coating described in U.S. Pat. No. 3,904,104, granted Sept. 9, 1976, to William P. Kane the tray minus certain modified construction referred to hereinafter is basically the same as described and illustrated in co-pending U.S. Application Ser. No. 163,809 filed June 27, 1980, now abandoned.

The blank 12 is divided by parallel, transversely spaced, longitudinal score lines 14 and 15, into a central panel section 16 and oppositely disposed side sections 17 and 18. The central panel forming section 16 is further divided by parallel, transverse score lines 20 and 22, which are longitudinally spaced to cooperate with the longitudinally extending score lines 14 and 15 in forming a bottom wall panel 23 having the dimensions desired for the product to be processed, end wall forming sections 24 and 25 of corresponding width and of a dimension lengthwise of the blank sufficient to provide the desired size of the product, and a double panel end wall structure. The end wall forming sections 24 and 25 are subdivided by a pair of parallel score lines 26, 27 and 28, 30 to provide inner and outer end wall panels 32, 33 and 34, 35 of equal dimension in the longitudinal direction of the blank, and relatively narrow strip panels 36, 37 at each of the marginal ends of the blank. The strip panels 36, 37 which are at the ends of the blank and the adjoining inner end wall forming panels are shortened at the opposite ends by notching out the four corners of the blank so that opposite end edges are approximately aligned with the longitudinal lines 15 and 16, or only slightly offset inwardly thereof. Each of the inner end wall forming panels 33 and 35 has small locking tab formations 38, 38' and 40, 40' extending outwardly of the end edges of the panels adjoining the transverse fold lines or hinge score lines 27 and 30. The side wall forming panel sections 17 and 18 are divided into inner and outer panel forming members 42, 43 and 42', 43' by fold forming score lines indicated at 46 and 46'. In FIG. 7 the inner panels 43 and 45, which have a somewhat lesser width than the outside panels 42 and 45, are folded on the score lines 46 and 46' into face engagement with the inside faces of the panels 42 and 45 and adhesively secured preparatory to setting up the container. At their opposite ends the outside wall panels 42 and 44 are integrally connected with the opposite ends of the outer end wall panels 32 and 34 by foldable web formations 47, 47' and 48, 48' which are of identical construction and only one of which will be described in detail. At the corner 47 the end portions 48, 48' of the longitudinal score lines and the end portions 50, 50' of the transverse score lines 15 and 20 extend from the intersection of the longitudinal score lines 15 and 16 with the transverse score lines 20 and 22 and and form a web section which is divided into two triangular panels 53 and 54 by a diagonal hinge-score line 55 extending from the score line intersection 52. In the same manner, at the other end of panel 32, a like web section 53' and 54' is formed. The outside end wall panel 32 has diagonal hinge-score lines 56, 56' at opposite ends thereof which extend inwardly and outwardly of the points of the score line intersections 52 and 52' on lines approximately normal to the diagonal web dividing lines 55, 55' to points 57 and 57' spaced from opposite ends of the hinge score line 26 so as to form a further foldable triangular panel 58, 58' at each end of the panel 32. However, the panels 58, 58' remain connected to the inner end panel 33 by perforated end portions 60 and 60' of the end panel dividing score line 26, for a purpose hereinafter described. The inner side panels 43 and 45 are extended in part at opposite ends to form small corner connecting reinforcing tab members 62, 62' which project beyond the score lines 50, 50' and are foldable on the small score lines 63, 63', the latter being aligned with score lines 50, 50' at the ends of the outer sidewall forming panels 42 and 44. The reinforcing tabs are cut free of the adjoining web panels 53 and 53'. The outermost corners of the ends of the inner wall forming panels 43 and 45 are notched out to provide pockets 64, 64' for receiving the locking tabs 38 and 38' on the ends of the inner end wall panel 33 when the container side and end walls are erected to form the tray. The corner structures at 48 and 48' at the opposite end of the blank are cut and scored in the same manner. In order to provide guide lines for cutting the product in uniform size portions, the score lines 46, 46' and 26, 28 are punched or notched at equal measured intervals, or otherwise permanently marked, so that the resulting marks will be observable on the top edges of the side and end walls in either the set-up or the flattened position.

In supplying the carton to the baker or other user the inner side wall forming panels 43 and 45 are hinged about the score lines 46 and 46' into face relation with the inside faces of the outer sidewall panels 42 and 44 and adhesively secured except for the corner top margin reinforcing tabs 62, 62'. These double panel sidewalls are then swung on the score lines 14 and 15 to upright position along with the end wall structures which automatically folds the corner web structures 47, 48 and 47', 48' so that they may be positioned to lie against the inner faces of the outside end wall panels 32 and 34 along with the reinforcing corner connecting tabs associated with the inner sidewall panels 43 and 45 where they may be covered by the inner end wall panels. The inner end wall panels 33 and 35 are then folded about the score lines 26 and 28 into face engagement with the inside faces of the outer end wall panels 33 and 34 while the associated locking tabs 38, 38' and 40, 40' are hinged inwardly so as to fit in edge engaging locking relation into the cooperating pockets 64, 64' at each end of the inner side wall forming panels 43 and 45.

Figure 2:
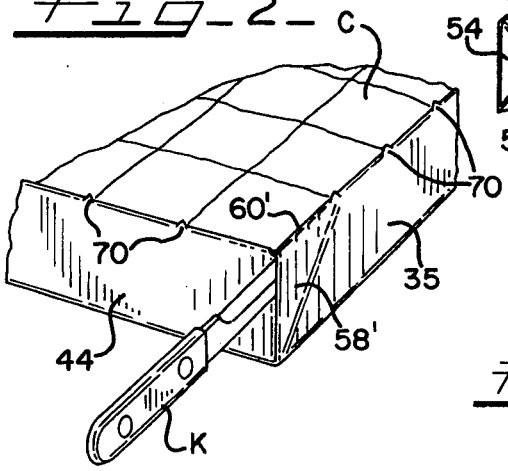
FIG. 2 is a partial perspective view, to a larger scale, showing a corner of the tray of FIG. 1 with the completed cake ready to be cut and with a knife in place for releasing the corner arrangement to permit the sidewalls to be folded flat without disturbing the cake.
Figure 3:
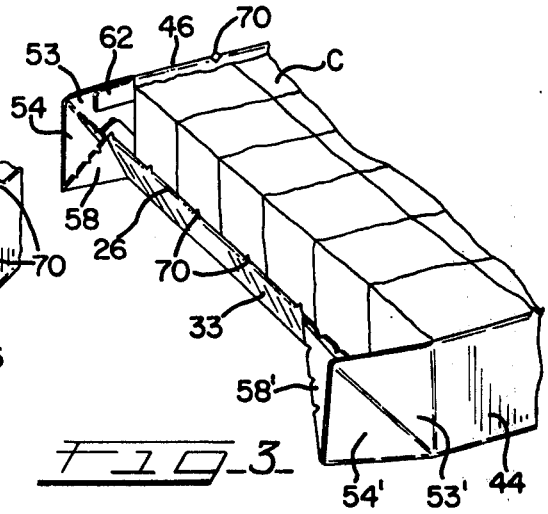
FIG. 3 is a partial perspective view similar to FIG. 2 but showing the entire end section of the carton with the corner webs cut loose and the end wall being partially swung into the open position.

The cake mix may then be placed in the tray and the product baked in a conventional baking oven without any substantial damage to the tray. The icing or other decorating may be applied to the cake after it is removed from the oven without removing it from the tray and it is ready to cut into serving portions with a conventional knife guided by the tabs formed by the notches 70 (FIG. 2). Alternatively, the perforated or otherwise weakened end section 60' at the corner may be cut by a knife K to release the corner web fold sections 58, 58 and permit the side and end walls to be swung down to the flat condition of FIG. 4 whereupon the serving pieces can be readily removed without damage.

A telescoping lid 75 (FIG. 8) is provided which may be any well known type carton construction for closing the tray 10 when the side and end wall formations are hinged to an upright position, for example, when the product is not all served and portions may be retained in the carton for subsequent use.

What is claimed:

1. A container structure for handling a bakery product in the form of a sheet cake which is to be divided into serving portions after being baked in a conventional baking oven, decorated and cut without removal from the container, said container structure comprising a relatively shallow depth tray structure which is dimensioned to accommodate a sheet cake of substantial size, said tray structure being formed from a cut and scored blank of paperboard having a film coating enabling it to withstand conventional baking oven temperatures without destruction, said tray structure comprising a bottom wall forming panel and upstanding peripheral side and end wall forming double thickness panels with integral foldable corner connecting web structures, said side wall panels comprising an outer panel and an inner panel foldable about a top edge forming score line and adhesively secured to the inside face of said outer panel, said end wall forming panels comprising an outer panel integrally connected at its opposite ends to the adjacent ends of said side wall forming outer panels by said foldable web structure, said web structure each comprising a pair of integral triangular web portions foldable upon each other and against the inner face of the outer end wall panel, said side wall forming inner panels each having at opposite ends small locking recesses adjacent the inner bottom corners, and said inner end wall forming panels each having at its inner bottom corners bendable locking tab elements which are contoured and dimensioned to fit in said locking recesses, said inner end wall forming panels having hinged marginal strips adapted to be positioned on the inner face of the bottom wall forming panel and extending along a hinge line, said end wall forming outer panels having diagonal scores at each end extending from the bottom hinge line to an end wall top edge forming score line about which said inner and and outer end wall panels are folded forming said double thickness end walls and thereby entrapping said foldable web structure therebetween when said container structure is erected, said end wall top edge forming score lines having the terminal portions thereof perforated to form readily torn terminal fold portions for readily releasing said foldable web structure entrapped between the ends of the inner and outer end wall panels and thereby freeing the end and side walls for downward hinging movement to provide ready access to the end portions of the product.

2. In the container structure set forth in claim 1 wherein said entire peripheral walls are formed for downward swinging movement upon severing the perforated terminal portions of the folded end wall at the top edge fold line to release the web connections at the corners for unfolding.

3. In the container structure set forth in claim 1 said side wall forming panels having at their opposite ends hinged reinforcing tabs adjacent the top fold lines which are foldable with the web connections to reinforce the corner structure.

4. In the container structure set forth in claim 1 said double panel side wall and end wall formations having uniformly spaced notches in the top fold line which serve as guide means for cutting the product into smaller serving pieces and provide for consistent portion control.

* * * * *